US006267581B1

(12) United States Patent
Harrison

(10) Patent No.: US 6,267,581 B1
(45) Date of Patent: Jul. 31, 2001

(54) MISTING CANDLE SNUFFER

(76) Inventor: Vikki Harrison, 800 Jill Jean Ave., Bakersfield, CA (US) 93308

( * ) Notice: Subject to any disclaimer, the term of this patent is extended or adjusted under 35 U.S.C. 154(b) by 0 days.

(21) Appl. No.: 09/659,918

(22) Filed: Sep. 12, 2000

(51) Int. Cl.[7] ..... F23Q 25/00
(52) U.S. Cl. ..... 431/145; 431/144
(58) Field of Search ..... 431/144, 145, 431/269, 33, 288, 289; 126/25 C; 362/112

(56) References Cited

U.S. PATENT DOCUMENTS

| | | | | |
|---|---|---|---|---|
| 717,186 | * | 12/1902 | Galipeau | 431/145 |
| 2,629,516 | * | 2/1953 | Badham | 362/112 |
| 2,785,556 | * | 3/1957 | Smith | 431/145 |
| 3,362,586 | * | 1/1968 | Dedoes | 126/25 C |

FOREIGN PATENT DOCUMENTS

| | | | | |
|---|---|---|---|---|
| 3906148 | * | 7/1989 | (DE) | 431/144 |

* cited by examiner

*Primary Examiner*—James C. Yeung
(74) *Attorney, Agent, or Firm*—Stetina Brunda et al.

(57) ABSTRACT

A misting candle snuffer for substantially minimizing the production of smoke following the extinguishment of a candle flame. According to a preferred embodiment, the invention comprises a elongate handle member having proximal and distal ends. Formed within the proximal end is reservoir for containing a quantity of fluid, such as water. A port is provided to access such reservoir. The proximal end further includes a trigger mechanism that can be accessed by the fingers or hand of the user that is in communication with the reservoir. A channel is provided that extends the length of such handle member and is in fluid communication with the reservoir such that actuation of the trigger mechanism causes water to be forced therethrough. A conical or bell-shaped housing is formed at the distal most end of the handle member and in fluid communication with the channel disposed within the handle that is operative to disperse or mist a quantity of fluid contained within the reservoir when the trigger is actuated. In use, once the housing is placed upon the candle flame sought to be extinguished, the trigger mechanism may be actuated such that the mist distributed via the housing formed on the distal end of the handle prevents smoke from dispersing around to the surrounding air.

11 Claims, 1 Drawing Sheet

MISTING CANDLE SNUFFER

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

Candle Snuffers are well-known in the art and have been utilized for centuries. Essentially, the candle snuffer comprises an elongate handle member having proximal and distal ends. Formed upon the distal-most end of the snuffer is typically provided a conical or bell-shaped housing that is positionable upon the burning wick of a candle to thus extinguish the flame produced thereby. In this regard, the housing formed on the snuffer is operative to deprive oxygen to the candle flame.

Despite their effectiveness, however, the use of conventional candle snuffers produces significant drawbacks. The most significant of such drawbacks includes a substantial production of smoke that is generated following extinguishment of the candle flame. As is well-known, such smoke is produced as a result of the wick being caused to burn, as opposed to the tallow or wax material of the candle. In this respect, during the time a candle flame burns, the wick, which typically comprises a bundle of fibers or a loosely twisted, braided or woven cord of soft spun threads, is operative to draw up the liquified tallow wax substances in candles via capillary action to thus cause the same to burn at a steady rate. Once the extinguishing process, terminates the capillary attraction that draws the tallow/wax up to flame, the wick itself is then burned, and consequently produces the undesirable smoke.

Indeed, the production of smoke following the extinguishing of candles can be exceptionally problematic insofar as candles are often made to produce desirable scents that are given off when burned and the subsequent production of smoke that is generated when the candle is extinguished can substantially if not completely ruin such desired effect. Moreover, to the extent multiple candles are extinguished in a given room, substantial quantities of smoke can be produced which is not only irritable to those present in the room but can further cause furniture, carpet or other furnishings to accumulate smoke residue. The latter phenomenon is particularly problematic given the repeated nature by which most candles are typically utilized.

Accordingly, there is a substantial need in the art for a candle snuffer that is operative to extinguish a candle flame that further substantially reduces, if not eliminates the production of smoke thereafter. There is a further need in the art for such a candle snuffer that is of simple construction, exceedingly simple to operate, inexpensive to manufacturer, can be repeatedly used, and will not interfere with the ability of a candle to be repeatedly used when such candle snuffer is utilized therewith.

BRIEF SUMMARY OF THE INVENTION

The present invention specifically addresses and alleviates the above-identified deficiencies in the art. In this regard, the present invention is directed to a misting candle snuffer that is operative to extinguish the flame of a candle that further substantially minimizes the production of smoke thereafter. According to a preferred embodiment, the candle snuffer comprises an elongate handle member having proximal and distal ends. A hand grip portion is formed on the proximal-most end thereof, the interior of which preferably defines a reservoir for receiving and holding fluid, such as water. A port is further provided to enable fluids to be introduced into such reservoir. The hand grip portion further preferably includes a trigger mechanism that is fluidly connected to the reservoir that may be actuated by the hand or fingers of the user. Disposed within the handle member along the length thereof is a channel that is fluidly connected to the reservoir that enables fluid disposed within the reservoir to flow therethrough to the distal-most end of the handle. Formed upon the distal-most end of the handle member is a conical or bell-shaped housing which is configured to be positioned upon the burning flame of a candle, as per conventional candle snuffers. Such housing, however, is fluidly connected to the channel formed upon the handle such that when the trigger mechanism is actuated, fluid is forced to flow from the reservoir through the channel and ultimately through the housing such that a quantity of mist is produced thereat that, when the candle is snuffed, it is distributed about the wick such that any smoke produced therefrom is prevented from dispersing into the surrounding air. The candle snuffer of the present invention may further be designed to take any of a variety of decorative configurations, and may be further formed from any of a variety of materials well-known to those skilled in the art.

It is therefore an object of the present invention to provide a misting candle snuffer that is effective in extinguishing candles that likewise substantially reduces the production of smoke following extinguishment.

Another object of the present invention is to provide a misting candle snuffer that, in addition to substantially reducing the amount of smoke produced from an extinguished candle, is further easy to manipulate and may be readily deployed.

Another object of the present invention is to provide a misting candle snuffer that can be formed to take any of a variety of decorative configurations and may be formed out of a variety of well-known materials.

Still further object of the present invention include providing a misting candle snuffer that is of simple construction, easy to manufacture, maybe repeatedly utilized, and does not interfere or otherwise effect the ability of a candle to be repeatedly utilized.

BRIEF DESCRIPTION OF THE SEVERAL VIEWS OF THE DRAWING

These as well as other features of the present invention will become more apparent upon reference to the drawings wherein.

DETAILED DESCRIPTION OF THE INVENTION

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Figure 1:
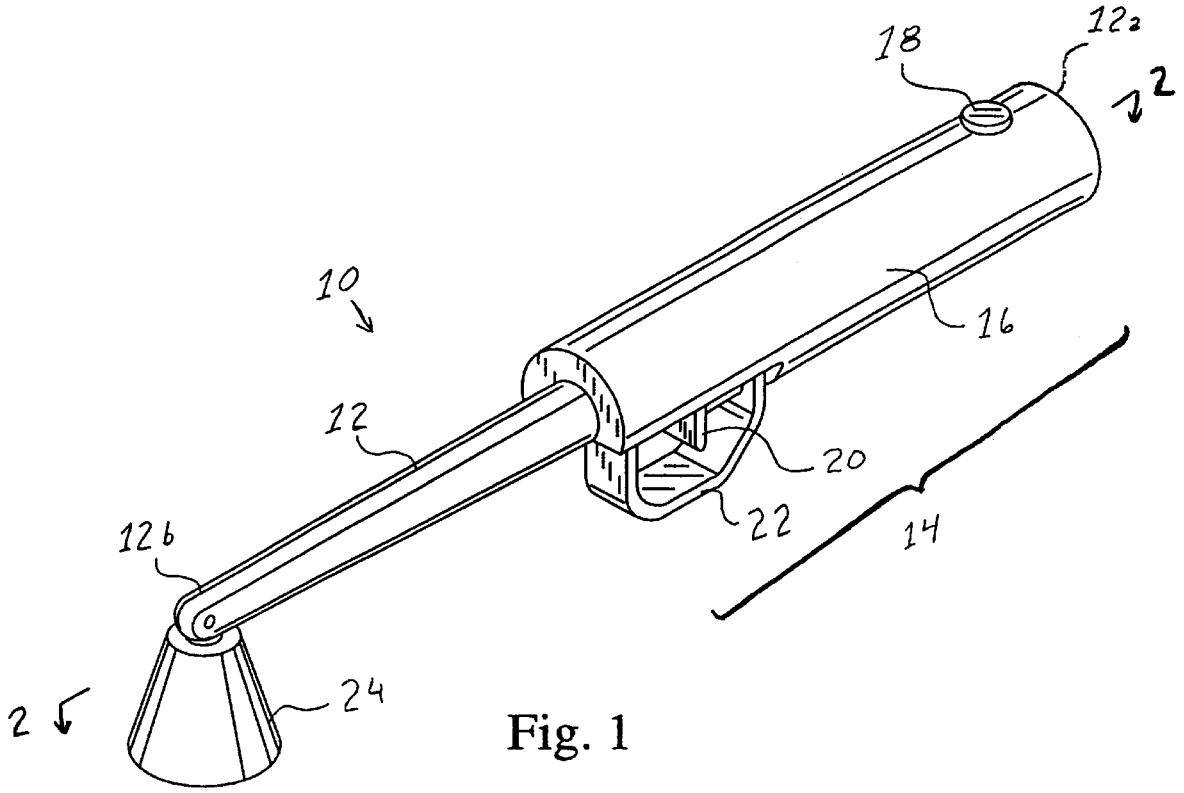
FIG. 1 is a perspective view of a candle snuffer constructed in accordance with a preferred embodiment of the present invention.

Referring to the drawings, and initially, to FIG. 1 there is perspectively illustrated a misting candle snuffer 10 as constructed in accordance with a preferred embodiment of the present invention. As illustrated, the snuffer 10 comprises an elongate handle member 12 having a proximal end 12a and distal end 12b. Formed upon the proximal end 12a of member 12 is a grip portion 14, the latter of which comprising body portion 16 with port 18 formed thereon, trigger 20 and trigger guard 22. As discussed more fully below, such body portion 14 is operative to supply and transfer an aerosol mist to the distal end of the snuffer 10 to thus facilitate extinguishing the candle flame and further, substantially reduce the production and dispersion of smoke following flame extinguishment.

In accomplishing that end, there is provided an conical or bell-shaped housing 24 formed upon the distal-most end 12b of handle member 12. As per conventional snuffers, the housing 24 is sized and configured to be axially positioned atop a candle flame to extinguish the same. As discussed more fully below, however, such housing 24 is further operative to distribute mist about the wick of the candle to suppress smoke production and dispersion from the wick.

Figure 2:
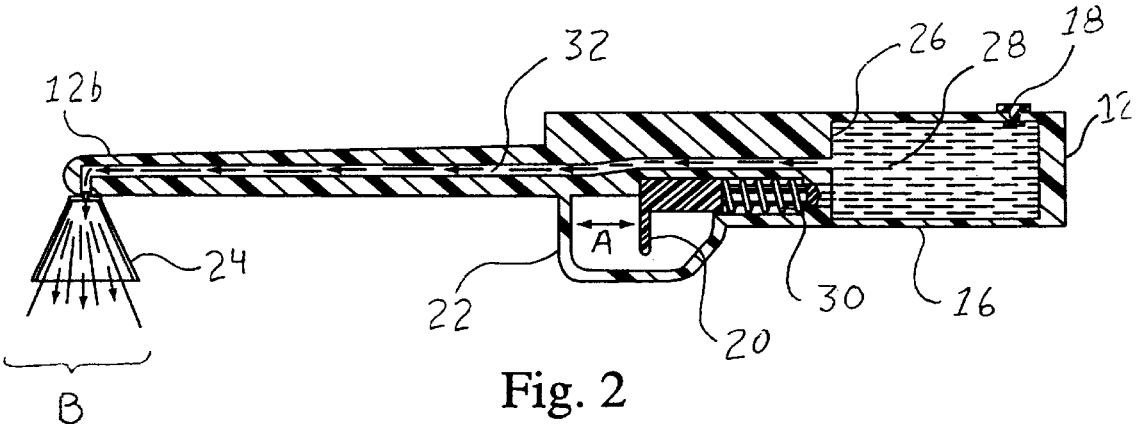
FIG. 2 is a cross-sectional view taken along lines 2—2 of FIG. 1.

Referring now to FIG. 2, there is shown a cross-sectional view of the snuffer 10 which illustrates how the same is operative to extinguish the candle flame while minimizing the production of smoke thereafter. As shown, disposed within body portion 16 is a reservoir 26 which is designed and configured to hold a quantity of fluid 28, which will preferably comprise water. The fluid 28 maybe introduced through removal port 18 such that the reservoir 26 maybe filled as shown. In fluid communication with the reservoir 26 is trigger member 20 which is operative to function as a pump when actuated in the direction indicated by the letter A such that by moving the trigger rearwardly toward the proximal end 12a causes an increase in pressure within reservoir 26 causing fluid to flow therefrom via channel 32. In this respect, trigger 20 is biased towards distal end 1 2b via spring member 30, as per conventional pump mechanisms, and that compression of trigger 20 will thus produce the desired pumping effect. It should be recognized, however, that countless varieties of hand pumps are available for use in practice of the present invention, and that the trigger mechanism pump as shown is merely one preferred embodiment thereof.

As further shown, fluid 28 within the reservoir 26 flows distally through channel 32 such that the same is caused to be dispersed through an aperture formed at the distal-most end 12b of the snuffer 10. Such aperture is in fluid communication with the housing 24 such that a portion of the fluid 28 is caused to distribute in a conical pattern as indicated by the letter B which, in use, will scatter about the candle flame sought to be extinguish. In this regard, the candle snuffer 10 is operative to work as a conventional snuffer, as well as impart a scrubber-type function, namely, extinguishing a candle flame while removing or otherwise preventing smoke from entering and dispersing into the surrounding air.

As will be recognized by those skilled in the art, the snuffer 10 may be designed and configured to take any of a variety of ornate styles or configurations. As discussed above, the pump mechanism, illustrated via trigger pump 20 may take any of a variety of forms operative to transfer fluid from a reservoir formed on the device out towards the distal-most end thereof. It is further contemplated that such snuffer 10 maybe fabricated from any of a variety of materials well-known in the art, including but not limited to any of a variety of metals, such as aluminum, copper, steel, iron, stainless steel and the like. It is further contemplated that the snuffer 10 may be designed and configured for use in a variety of applications, whether it be simple hand-held model as shown, or larger versions for use with larger candles, such as those typically utilized in religious or ceremonial purposes. Along these lines, it is contemplated that the housing 24 formed on the distal-most end 1 2b of the snuffer 10 may be configured and oriented of any of a variety of purposes. To that end, it is contemplated that such housing 24 may even be pivotally mounted on the distal-most end 12b to thus enable the snuffer 10 to assume configurations suitable for a given purpose. Accordingly, it is intended that all reasonably foreseeable additions, modification, deletions, and alterations be included within the scope of the invention as defined in the following claims.

What is claimed is:

1. A misting candle snuffer for minimizing the production of smoke following extinguishment of a candle flame comprising:

(a) an elongate handle member having proximal and distal ends;

(b) a housing formed on a distal-most end of said handle member;

(c) a reservoir disposed within said handle member, said reservoir being operative to receive and hold a quantity of fluid therein;

(d) a pump mechanism coupled to said reservoir for directing said fluid therefrom; and (e) wherein said pump and said reservoir are so disposed within said handle such that when said pump is actuated, a portion or fluid stored within said reservoir is forced outwardly through said housing in a generally conical pattern axially downward about said flame that is operative to extinguish said flame and substantially minimize smoke generated thereafter.

2. The misting candle snuffer of claim 1 wherein said snuffer further includes a removable port formed upon said handle member and in fluid communication with said reservoir to enable fluid to be introduced into said reservoir.

3. The misting candle snuffer of claim 1 wherein said pump mechanism comprises of manually operable pump.

4. The misting candle snuffer of claim 1 wherein said snuffer is formed from metal.

5. The misting candle snuffer of claim 4 wherein said metal is selected from the group consisting of copper, steel, aluminum, iron, and stainless steel.

6. A misting candle snuffer for minimizing the production of smoke following extinguishment of a candle flame comprising:

(a) an elongate handle member having proximal and distal ends;

(b) a reservoir disposed within said proximal end of said handle member having a channel extending therefrom, said channel extending along the length of said handle and terminating at the distal end thereof;

(c) a housing formed upon the distal end of said handle member and fluid communication with terminating end of said channel;

(d) a pump mechanism formed upon said handle member and operatively coupled to said reservoir such that actuation of said pump forcibly causes fluid stored within said reservoir to flow through said channel and outwardly through said housing in a generally conical pattern axially about said flame that is operative to extinguish said flame and substantially minimize downward smoke generated thereafter.

7. The misting candle snuffer of claim 6 wherein said housing comprises a conical or bell-shaped housing configured and oriented to be axially positioned upon the burning flame of a candle.

8. The misting candle snuffer of claim 6 wherein said when said pump mechanism is actuated, said fluid is caused to be dispersed about the interior of said housing such that the wick of said candle is caused to be substantially contacted with the fluid dispersed thereabout.

9. A method for minimizing the production of smoke following the extinguishment of a candle flame comprising the steps:

(a) providing a lit candle;

(b) providing a misting candle snuffer, said misting candle snuffer comprising:

i. an elongate handle member having proximal and distal ends;

ii. a housing formed on a distal-most end of said handle member;

iii. a reservoir disposed within said handle member, said reservoir being operative to receive and hold a quantity of fluid therein;

iv. a pump mechanism coupled to said reservoir for directing said fluid therefrom; and v. wherein said pump and said reservoir are so disposed within said handle such that when said pump is actuated, a portion of fluid stored within said reservoir is forced outwardly through said housing.

(c) positioning said housing of said misting candle snuffer axially upon the flame of said candle;

(d) actuating said pump of said misting candle snuffer such that a portion of said fluid stored within the reservoir of said misting candle snuffer is distributed axially about said flame of said candle; and (e) withdrawing said housing from said candle.

10. The method of claim 9 wherein in step (b), said reservoir of said misting candle snuffer is operative to receive and hold a quantity of water.

11. The method of claim 9 wherein in step (b), said housing of said misting candle snuffer comprises a conical or bell-shaped housing; and wherein in step (c), actuation of said pump is operative to distribute a portion of said fluid stored within said housing in a generally conical shape about said lit candle.

* * * * *